US007252210B1

(12) United States Patent
Schultz et al.

(10) Patent No.: US 7,252,210 B1
(45) Date of Patent: Aug. 7, 2007

(54) ARTICLE TO HOLD AND REMOTELY SPRAY AN AEROSOL SPRAY CONTAINER

(76) Inventors: Edwin R. Schultz, 5400 Lytle Rd., Waynesville, OH (US) 45068; Ian A. Schultz, 8100 Mitchell Dewitt Rd., Plain City, OH (US) 45064

( * ) Notice: Subject to any disclaimer, the term of this patent is extended or adjusted under 35 U.S.C. 154(b) by 636 days.

(21) Appl. No.: 10/755,099

(22) Filed: Jan. 12, 2004

Related U.S. Application Data

(60) Provisional application No. 60/447,020, filed on Feb. 13, 2003.

(51) Int. Cl.
*B67D 5/64* (2006.01)
*B65D 83/16* (2006.01)

(52) U.S. Cl. ..... 222/174; 222/402.13

(58) Field of Classification Search ..... 222/174, 222/402.1, 402.13, 402.15, 635
See application file for complete search history.

(56) References Cited

U.S. PATENT DOCUMENTS

| | | | | |
|---|---|---|---|---|
| 2,720,422 | A | 10/1955 | Mercur | |
| 3,017,056 | A * | 1/1962 | Bishop | 222/164 |
| 3,229,859 | A * | 1/1966 | Conroy et al. | 222/174 |
| 3,856,209 | A | 12/1974 | Hickson | |
| 4,023,711 | A * | 5/1977 | Sena | 222/174 |
| 4,092,000 | A | 5/1978 | Offutt, III | |
| 4,886,191 | A | 12/1989 | Yoshitomi | |
| 5,307,959 | A | 5/1994 | Bedore et al. | |
| 5,368,202 | A | 11/1994 | Smrt | |
| 6,450,423 | B1 * | 9/2002 | Gurule | 239/531 |
| 6,789,705 | B2 * | 9/2004 | Drew | 222/174 |
| 6,966,461 | B2 * | 11/2005 | Warner et al. | 222/174 |

* cited by examiner

*Primary Examiner*—Joseph A. Kaufman
(74) *Attorney, Agent, or Firm*—Charles R. Wilson

(57) ABSTRACT

An aerosol spray article is used to hold an aerosol spray container and spray an object with the container's contents from a remote locale. The article comprises a main body having a cord guide, a clip extending from the main body for holding the aerosol spray container, a pole adaptor adjustably mounted to the main body as needed, and a spray lever operably associated with the main body to contact the aerosol spray container's push button valve actuator. It further has a cord which extends from the spray lever, through the cord guide and along the extension pole to the user. The article allows a spray from the container to be emitted directly onto an object by the user standing at a locale remote from the object.

18 Claims, 9 Drawing Sheets

ARTICLE TO HOLD AND REMOTELY SPRAY AN AEROSOL SPRAY CONTAINER

This application claims the benefit of U.S. Provisional Application No. 60/447,020, filed Feb. 13, 2003.

FIELD OF THE INVENTION

This invention relates to an article for mounting, aiming, and activating an aerosol spray container containing an active ingredient. More particularly, the invention relates to an article for mounting, aiming, and activating an aerosol spray container which, when used with an extension pole, is capable of spraying an active ingredient with full force onto an object by the user at a remote locale.

BACKGROUND OF THE INVENTION

Aerosol spray containers holding a variety of active ingredients are well known and commonly used. Virtually every household has one or more aerosol spray containers for some purpose. Common outdoor uses in particular include aerosol spray containers with insecticides, herbicides, bug repellants, cleaning agents, freezing agents, lubricants, and paints.

Most aerosol spray containers have the same general configuration and active ingredient release mechanism. That is, the typical aerosol spray container has a cylindrical-shaped container with a push button valve actuator and a spray nozzle on a top side of the container. The push button valve actuator extends vertically from the container. An orifice in a side wall of the valve actuator represents the spray nozzle. A downward force, and also often slightly forward force, exerted on top of the valve actuator causes the contents, i.e. a pressurized propellent and the active ingredient in the container to be released through the spray nozzle. The spray release continues until the downward force is removed or the container's contents are emptied. The propellent and active ingredient leave the nozzle's orifice as a stream or spray, depending on the nozzle's design. In either case, the stream or spray is dispensed at a generally right angle to the longitudinal axis of the container. If the container is hand-held and if the desired object is close, the stream or spray can be accurately directed toward the object by simple hand and wrist manipulations.

As can be well imagined, the accuracy of the stream or spray emanating from an aerosol spray container is related directly to its distance from the object. The closer the container is located to the object the more accurate the aim and the greater the amount of contents which are released onto the object. Conversely, the further away the container is from the object the less accurate the aim and the lesser amount of contents which reach the object. This is caused by the contents general tendency to dissipate in air. In general, an aerosol spray container can spray no more than 25 feet. That distance decreases when the aerosol spray container is sprayed at an upward angle.

There are instances when it is desired to spray an object which is more than 25 feet. For example, stinging insects such as wasps, hornets, and yellow jackets frequently build their nests under house or garage eaves. These are typically unreachable from the ground. Even a ground-level stinging insect nest may be considered unreachable if a safe distance is to be maintained. Numerous target objects such as caterpillar cocoons in a tree at all levels is as well a challenge. Even low lying areas that need to be sprayed can be difficult if it involves bending or crawling along ground surface. This includes the underside of decks, picnic tables, and playground equipment. Health concerns regarding skin contact or inhalation of the active ingredient by the user is also a reason to maintain a distance of several feet from the spray of the aerosol spray container.

There have been attempts by others to develop a product which is capable of initiating a spray of the aerosol spray container's contents from a remote locale, e.g. greater than about six feet. Known products mount the aerosol spray containers at the end of a specially designed pole. A mechanism connected to the aerosol spray container is pulled or squeezed by the user. All known products have limitations and are considered unacceptable. Some are complex in design and costly to manufacture. Some are difficult to transfer a sufficient force to the spray nozzle to easily initiate the spray. Examples of the known products are described in U.S. Pat. Nos. 4,092,000, 4,660,745, 4,886,191, 5,307,959, 5,368,202, and 5,799,835. Most importantly, none of the known products enable the user to angle the aerosol spray container a full 90 degrees for enhanced aim.

In accord with a need experienced by many households and commercial establishments, there has now been developed an article for holding an aerosol spray container which, when used in conjunction with a standard extension pole, allows use of a cord triggering mechanism which can be many feet away from the container's push button valve actuator. The article holds the aerosol spray container firmly while allowing it to be adjusted to an angle conducive to accurate aiming of the container's contents directly onto an object with full force. Over-spray is alleviated. The aerosol spray container's push button valve actuator is forced downwardly and forwardly to release the spray when a pulling force is initiated by the user many feet away. The article is economical to manufacture, easy to use and effectively performs its desired objective.

SUMMARY OF THE INVENTION

An article, attachable to an extension pole, firmly holds an aerosol spray container in a manner which allows some aiming adjustability and easy activation from a remote locale. The article comprises a main body, a clip extending from the main body for holding the aerosol spray container, a pole adaptor rotatably attached to the main body and having a pole-receiving receptacle, a cord guide in the main body, a spray lever operably associated with the main body and a cord. The cord extends from the spray lever, along the cord guide in the main body, and then along the attached extension pole to the point held by the user. The angle of the main body holding the aerosol spray container relative to the extension pole is first adjusted to an angle conducive to spraying an object. Then, the extension pole with the article and aerosol spray container is guided close to the object to be sprayed. A pull on the cord transmits a force to the spray lever which then engages the container's push button valve actuator. The stream or spray which emerges is propelled directly onto the object with full force.

DETAILED DESCRIPTION OF THE INVENTION

The article of the invention is useful with aerosol spray containers of varying sizes and containing various active ingredients. Aerosol spray containers commercially sold and commonly available tend to be cylindrical-shaped and hold from about 15 oz. to about 18 oz. of propellent and active ingredient. They all have a push button valve actuator and a spray nozzle mounted on a top of the container which may or may not have a safety feature of some design to guard against accidental spraying. Many, but not all, push button valve actuators release the container's contents only if they are pushed both downwardly and slightly forwardly. The article of this invention is ready for use with all of the commonly available cylindrical-shaped aerosol spray containers. It is also readily adapted for use with other shaped and sized aerosol spray containers.

Figure 1:
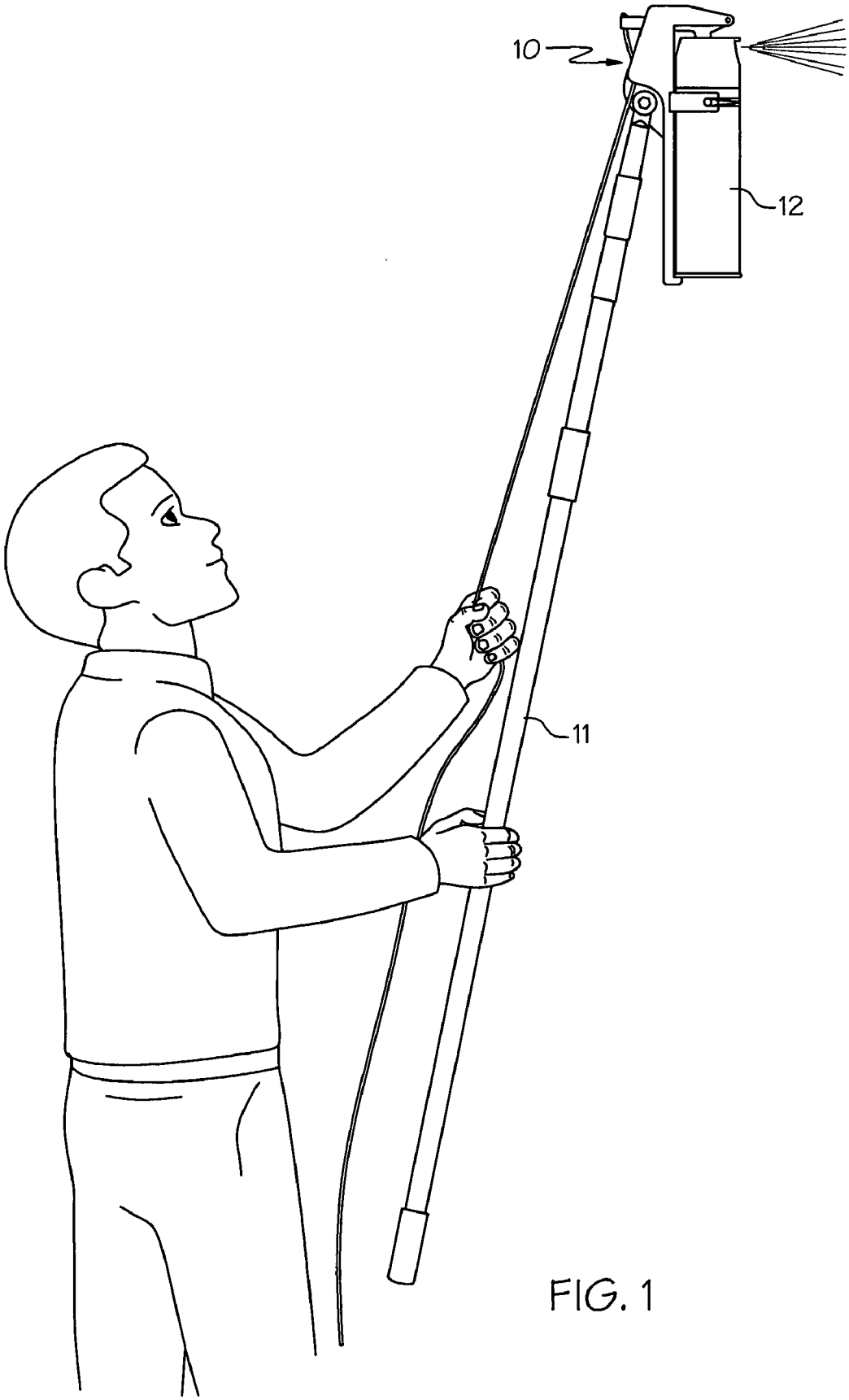
FIG. 1 is an environmental view of the article of the invention mounted on an extension pole and holding an aerosol spray container in position for the user to spray an object.

With reference to FIG. 1, the article 10 is shown mounted on an extension pole 11 and holding a conventional 15 oz. cylindrical-shaped aerosol spray container 12. The user is in the process of propelling a fan-shaped spray pattern from the container's spray nozzle at a distance such as may occur in spraying a hard-to-reach wasp's nest. The user is depicted at a remote and relatively safe locale from the aerosol spray container and the object being sprayed. Safety should be evident from the fact a step ladder or some other temporary structure does not need to be climbed. Further, the user is not in close proximity to the wasp's nest and has time to quickly vacate the premises in case of threatening wasp actively. Still further, inhalation of the active ingredient is at least reduced, if not eliminated.

As used herein, remote locale is defined to mean any location greater than about six feet from the aerosol spray container. The distance to the object being sprayed is only limited by the length of the extension pole. This can be substantial given the fact telescoping extension poles which extend to over ten feet are available.

Figure 2:
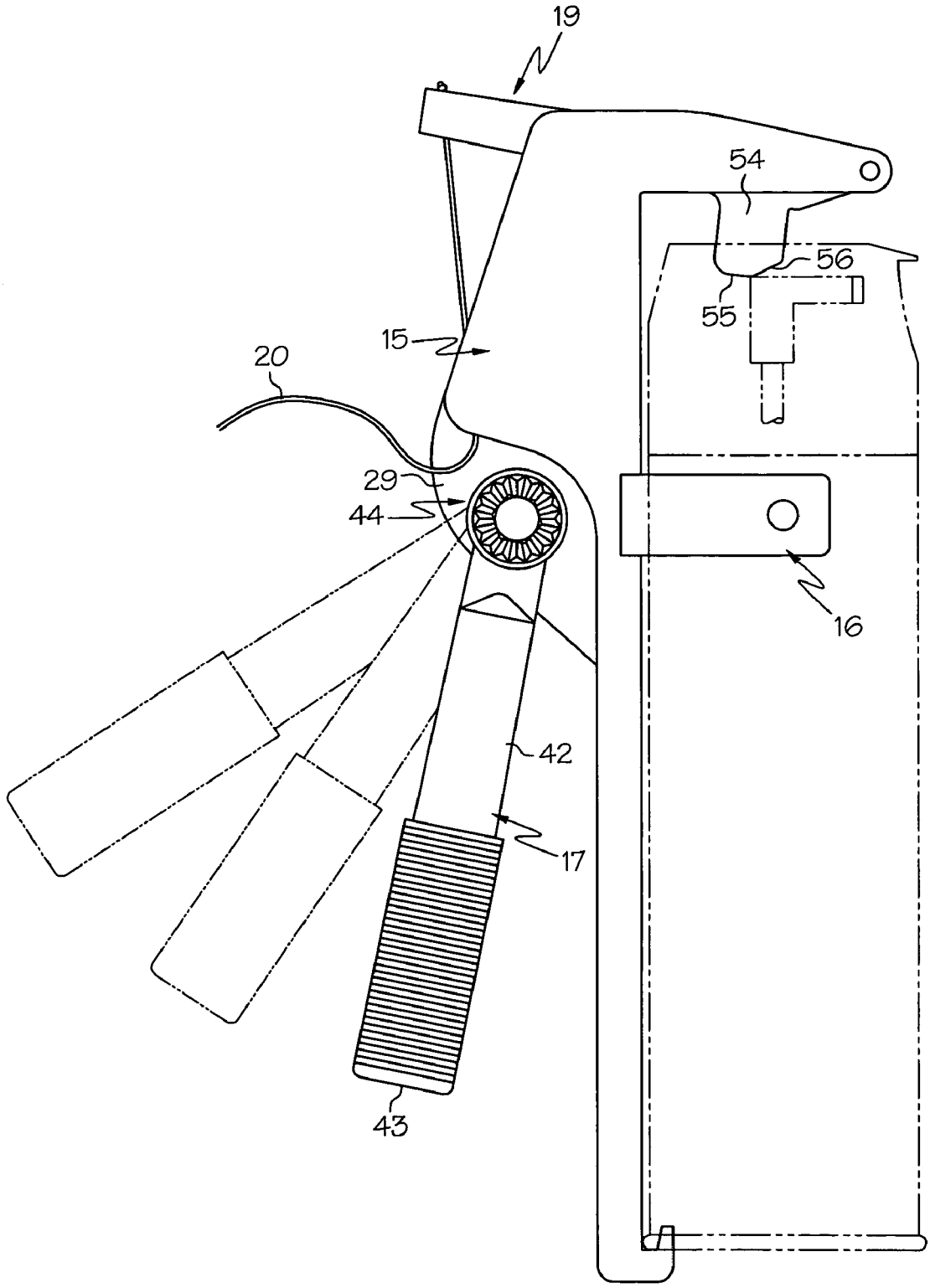
FIG. 2 is a side elevation view of the article of FIG. 1 showing an angle adjustability feature of the article.
Figure 3:
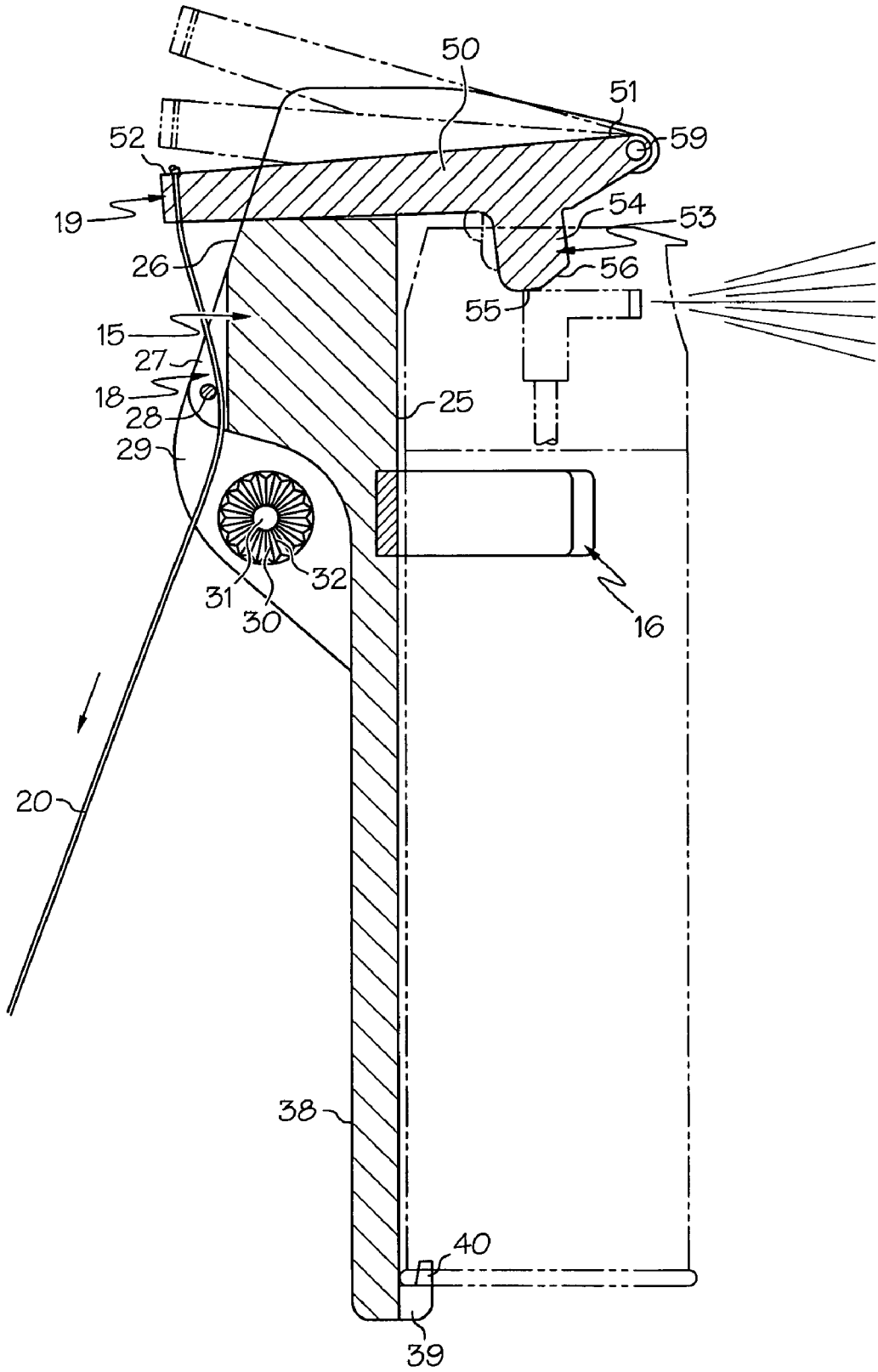
FIG. 3 is a side elevation view in section of the article of FIG. 1 with a pole adaptor removed for illustration purposes.
Figure 4:
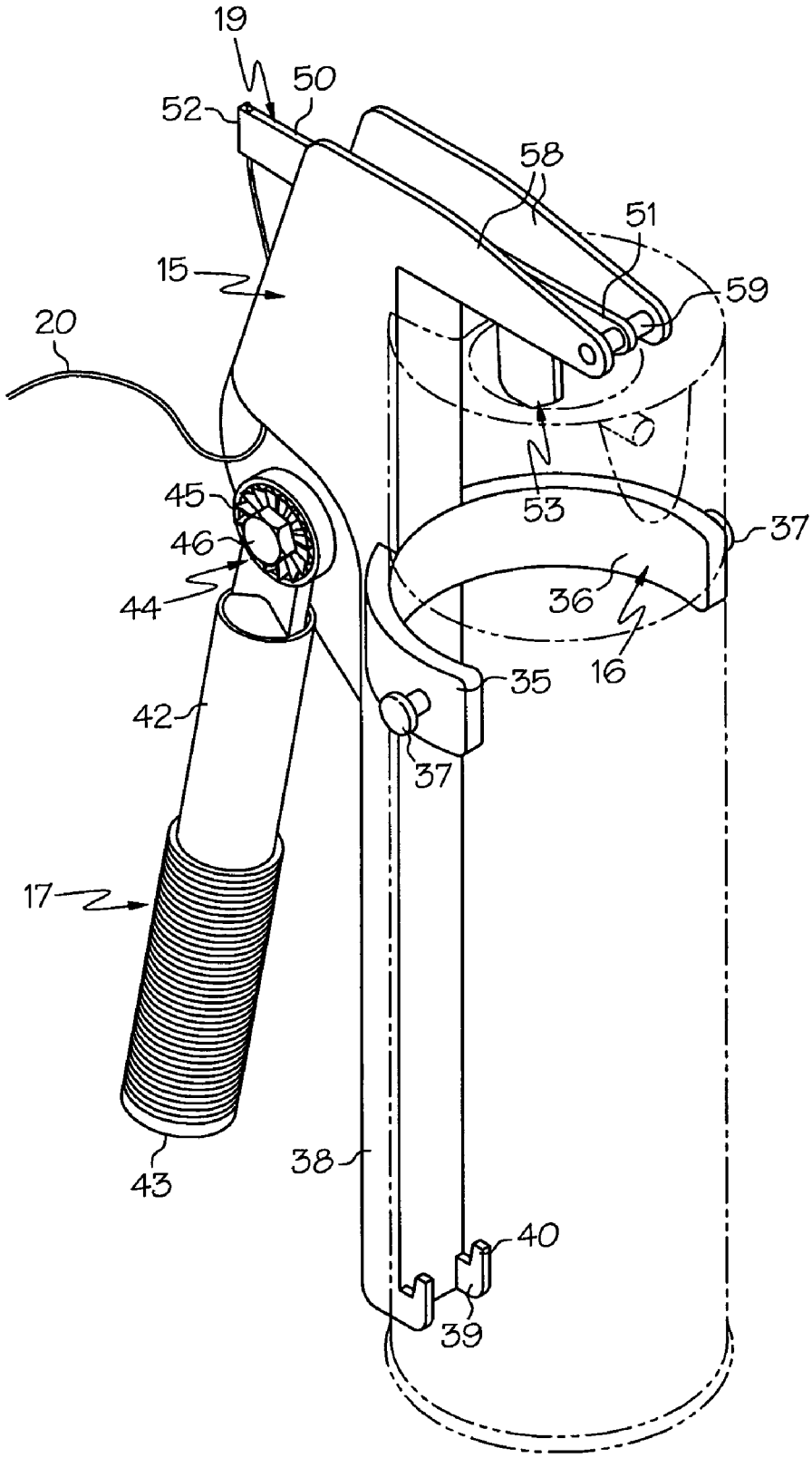
FIG. 4 is a perspective view of the article of FIG. 1.

The article 10 is best seen in FIGS. 2-4. It comprises a main body 15, a clip 16, a pole adaptor 17, a cord guide 18 (seen in FIG. 3), a spray lever 19 and a cord 20. The extension pole 11 evident in FIG. 1 is commercially available. It has a male threaded terminus which readily screws into a female threaded receptacle of the pole adaptor 17. It can have a telescoping feature for even greater lengths. The components of the article 10 are described in detail in the following paragraphs.

Now with reference to FIGS. 3 and 4, a front wall 25 of the main body 15 receives the aerosol spray container. The front wall can be substantially flat or preferably, be curved to receive flush a portion of the aerosol spray container for better holding and aesthetic reasons. The main body 15 also has an opposed back wall 26. As most apparent in FIGS. 2 and 3, the back wall 26 is sloped inwardly towards the front wall 25 to accommodate the cord's routing to the spray lever 19.

The opposed back wall 26 of the article 10 has a narrow groove 27 extending substantially vertically from a lower edge to a mid-section of the main body. The groove 27 together with a guide pin 28 serves as the cord guide 18 by providing a channel through which the cord 20 passes. The guide pin 28 extends horizontally across the groove 27 and into the main body of the article to ensure that the cord is properly routed through the channel and remains in place.

As readily imagined, the guide pin 28 can be replaced with a thin bridge extending across the narrow groove. The bridge can be molded into the main body 15 or simply adhered to opposed walls of the narrow groove 27. Further and instead of the narrow groove 27 and guide pin 28, a short tunnel can be configured into the back wall 26 of the main body 15 to serve as a cord guide. Still other structures can serve as a cord guide, one of which is illustrated and described with reference to FIGS. 5 and 6 below.

Still with reference to FIG. 3, the main body 15 also has a support bracket 29 extending downwardly. While not evident in the drawings, the support bracket 29 is offset from a center-line extending down the main body's back wall 26 so as not to interfere with the cord's routing during use. The support bracket provides a point of attachment for the pole adaptor 17. A first serrated fastener component 30 is positioned on the bracket. The serrated fastener component 30 has a circular shape with a center hole 31 and several equi-spaced radial serrations 32 emanating outward from the center hole 31. The serrations 32 interact with similarly configured serrations on a mechanically mating fastener component found on the pole adaptor 17 and described with reference to FIG. 4.

Now referring to FIG. 4, the clip 16 has inwardly curved arms 35 and 36 which extend substantially horizontally from the front wall of the main body 15. The curvature of the arms approximates that of the aerosol spray container. The clip 16 is made of a resilient plastic material which opens to receive the aerosol spray container and once fully inserted springs back to grasp the container in a friction fit. The arms 35 of the clip 16 can have sufficient resiliency to hold the container. Preferably, the clip's hold-power is enhanced by an elastic band (not shown) which stretches between knobs 37 positioned near the terminus of each arm 35.

Still further aerosol spray container hold-power for the article is provided by an optional inclusion of a leg 38 extending downwardly from the main body 15. A set of feet 39 extend at a substantially right angle from the leg 38. The length of the leg 38 and the length of the feet 39 are selected to accommodate a standard sized aerosol spray container. An upturned terminus member 40 on each of the feet 39 also helps to retain the aerosol spray container in place. This results from the typical aerosol spray container's configuration which has a lower rim. This lower rim fits in narrow slots formed by the upturned terminus member 40 and the leg 38 to keep the aerosol spray container from slipping down or sliding forward.

The pole adaptor 17 is depicted in FIGS. 2 and 4. It has an elongated body 42 with a pole-receiving receptacle 43 at a lower terminus and an adjustable attachment means 44 at the upper terminus. The receptacle 43 is a female threaded opening sufficiently deep to receive a male threaded terminus of the extension pole. Now with reference to FIG. 4, the attachment means 44 comprises a second serrated fastener component 45 to mechanically mate with the first serrated fastener component 30 positioned on the main body's support bracket. The fastener component 45 has a center hole. The attachment means further includes a bolt 46 extending through the center hole and a wing nut (not shown). The serrations in the first and second serrated fastener components mechanically mate. The bolt 46 extends through the two center holes of the fastener components and together with the wing nut when tightened securely hold the pole adaptor 17 to the support bracket 29 of the main body 15. As should be apparent, an angle of attachment of the pole adaptor to the main body is readily adjustable by loosening the wing nut, rotating the pole adaptor to the desired angle and then retightening the wing nut.

The attachment means 44 depicted on the pole adaptor 17 is highly preferred. It should be understood that other attachment means can also be used. A conventional bolt and nut with washers to hold the pole adaptor to the main body is one simple attachment means, though is less preferred because of the need to very securely tighten the nut to the bolt to prevent slippage. This normally necessitates the use of a wrench. Clamps of various designs can be used. Still other attachment means which allow angle adjustability are usable.

The spray lever is specially configured to meet the objectives of this invention. It is made to transfer a significantly greater force to the aerosol spray container's push button valve actuator than is supplied by the user. As evident, the force is transferred by the user pulling on the cord's proximal free end which is transferred to the cord's distal end at its point of attachment to the spray lever. The spray lever is also configured to accommodate different sized containers being held by the article. Most importantly, it is simple in design with minimal operational problems.

As best seen in FIGS. 3 and 4, the spray lever 19 has an elongated body 50 with a first end 51, a second end 52 and a mid-section actuator 53. The actuator 53 extends downwardly from the elongated body 50 of the spray lever 19 and is positioned to contact the aerosol spray container's push button valve actuator. The spray lever's function is to receive a force at its second end applied through the cord when pulled by the user and transfer it to the mid-section actuator 53 to create a greater downward force on the aerosol spray container's valve actuator. The spray lever pivots about its first end 51. The length of the spray lever's elongated body 50 and the positioning of the mid-section actuator 53 on the elongated body 50 are interrelated. The length of the spray lever's elongated body is dependent on the width of the main body 15. The positioning of the mid-section actuator 53 on the elongated body 50 is off-center to gain a mechanical advantage. The closer to the pivot point of the elongated body 50, located at its first end, the greater the mechanical advantage. An at least 3:1 mechanical force advantage is desired. Thus, a one pound pulling force executed on the cord by the user translates to a three pound pushing force on the container's spray button activator valve. Preferably, the mid-section actuator is positioned to achieve an at least 4:1 mechanical advantage.

The spray lever's mid-section actuator is a leg 54 which extends at an about right angle downwardly from the elongated body 50 a sufficient distance to contact the aerosol spray container's push button valve activator. As best seen in FIGS. 2 and 3, the leg 54 has a contacting pad comprised of a generally flat portion 55 and an upwardly sloped portion 56. FIG. 2 shows the spray lever 19 in a rest position with the generally flat portion 55 of the leg's pad in contact with container's push button valve activator. FIG. 3 depicts the spray lever 19 moving from the rest position to the active position wherein the generally flat portion 55 of the leg's pad remains in contact. This effectively imparts a downwardly and forwardly force onto the push button valve activator. As aforementioned, such a two directional force is needed to activate certain aerosol spray containers.

The pad profile of the mid-section actuator's leg described immediately above is designed to accommodate different length containers. As shown, a relatively short container is positioned in the article 10. A longer container can also be so positioned, though the upwardly sloped portion of the pad would then be in contact with the push button spray activator. In either case, the article 10 functions in the same manner with the same effectiveness.

The spray lever 19 is pivotally attached to the main body 15. For this purpose, the main body 15 has a pair of parallel horizontally extending arms 58 and a pivot pin 59 connecting the arms at one end. The arms extend from an upper portion of the main body. As readily apparent, the spray lever 19 is positioned between the arms 58 and attached at its first end 51 to the pivot pin 59 so as to pivot thereabout.

Activation of the aerosol spray container's push button valve actuator is caused by the user of the article 10 pulling on the cord 20. The cord-20 extends from the second end 52 of the spray lever 19 around the guide pin 28 on the main body 15 and then along the extension pole until it reaches the user. Placement of the guide pin 28 in the narrow groove 27 of the main body 15 ensures the angle of the cord relative to the spray lever is constant regardless of the angle of attachment selected for the pole adaptor and main body. This allows the spray lever to function independently of the spray angle. That is, the article sprays with the same effectiveness and ease of use regardless of angle of attachment. The cord guide 18 comprised of the narrow groove 27 and guide pin 28 most importantly ensures that the cord 20 does not get entangled with the rest of the article during use.

It should be understood cord as used here includes all types of long flexible materials of any content. Examples include string, twine, and wire made of natural and synthetic materials.

While not shown, one or more cord guide eyelets are normally added to the extension pole to hold the cord 20 close to the pole for maximum pull force transference and convenience of use. The cord is at least about ten feet long, through can be longer depending on the particular length of extension pole used.

Figure 5:
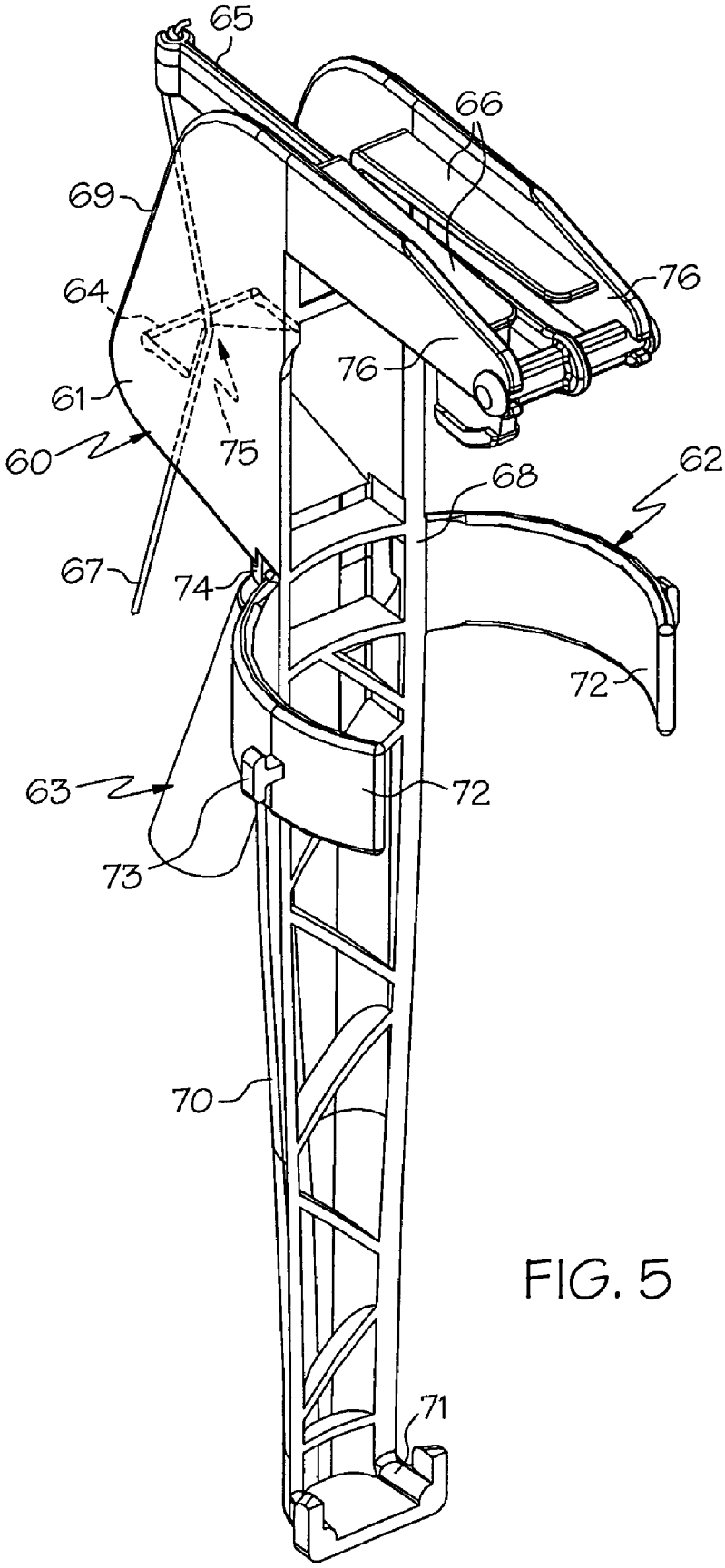
FIG. 5 is a perspective view of another article of the invention having an integral cord guide and spray lever guide fins molded into the article.
Figure 6:
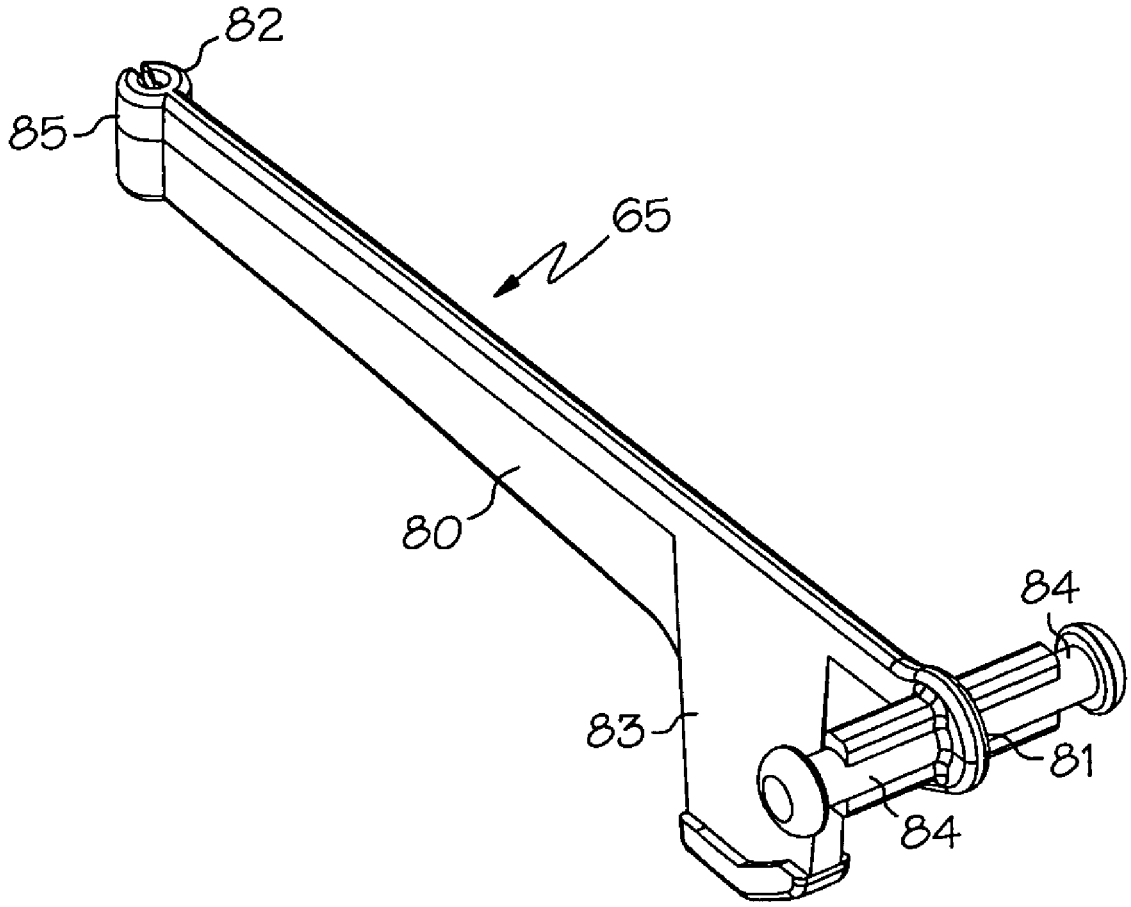
FIG. 6 is a perspective view of a spray lever isolated from the article of FIG. 5.

FIGS. 5 and 6 illustrate another embodiment of the invention wherein the cord guide and a pair of spray lever guide fins are integral with the main body, i.e. they are molded into the main body of the article to be unitary therewith. With reference to FIG. 5, the article 60 has a main body 61, a clip 62, a pole adaptor 63, a cord guide 64, a spray lever 65, spray lever guide fins 66 and a cord 67. FIG. 6 shows the spray lever 65 isolated from the article 60 for clarity of illustration.

The main body 61 of the article 60 is elongated with a front wall 68 and an opposed back wall 69. It includes an elongated leg 70 with feet 71 at a lower terminus for better holding an aerosol spray container. It is made by a molding process and preferably has an open ribbed design to decrease weight while retaining strength. The front wall 68 includes the rib tops.

The clip 62 which extends at an approximate right angle from the main body 61 has two curved arms 72 for grasping an aerosol spray container. A knob 73 on each of the curved arms 72 is to hold an elastic band for enhanced container holding power. Similar to the article 10 described above, the article 60 has a downwardly extending support bracket 74 and the pole adaptor 63 attached to it.

As evident, the main body 61 has an integral cord guide 64 comprised of a V-shaped member 75 positioned above the support bracket 74 and across the opposed back wall 69. The V-shaped member 75 effectively centers the cord 67 as it passes along an extension pole to its point of attachment on the spray lever 65. This ensures that a pulling force at one end of the cord is efficiently transferred to the spray lever. Two elongated arms 76 extend horizontally from the main body for providing a pivot point of attachment for the spray lever 65.

Now with reference to FIG. 6, the spray lever 65 has an elongated body 80 with a first end 81, a second end 82, and a mid-section actuator 83. Extending from the first end at approximate right angles to the elongated body 80 are two finger members 84. Ends of the finger members 84 are configured to fit into notches at the ends of the elongated arms 76 in a pivoting fashion.

The second end 82 of the spray lever 65 has a vertically slotted member 85 to receive an end of the cord and hold it in a permanent manner. The mid-section actuator 83 is similar in its configuration and function as the mid-section actuator 53 of the article 10's spray lever described above.

Again with reference to FIG. 5, the main body 61 of the article 60 further has spray lever guide fins 66 extending inwardly from the elongated arms 76 and parallel to one another. As apparent, the spray lever guide fins 66 ensure that the spray lever 65 remains centered between the elongated arms 76 for optimum operation.

In operation, the articles 10 and 60 of the invention are used in the same manner. The user positions an aerosol spray container in the article to fit against the front wall of the main body of the article and within its clip. An elastic band is attached to the clip if needed for enhanced hold power. An extension pole is attached to the article's pole adaptor. The user now, if not already done, adjusts the angle of aerosol container relative to the extension pole as needed. The user can now hold the extension pole and move the aerosol container to close proximity to the object to be sprayed. A pull on the article's cord causes the spray lever to pivot about its pivot point and force the spray lever's mid-section actuator down, which in turn forces the container's push button valve actuator down. A stream or spray of active ingredient is thus emitted onto the object by the user while standing at a remote locale.

Figure 7:
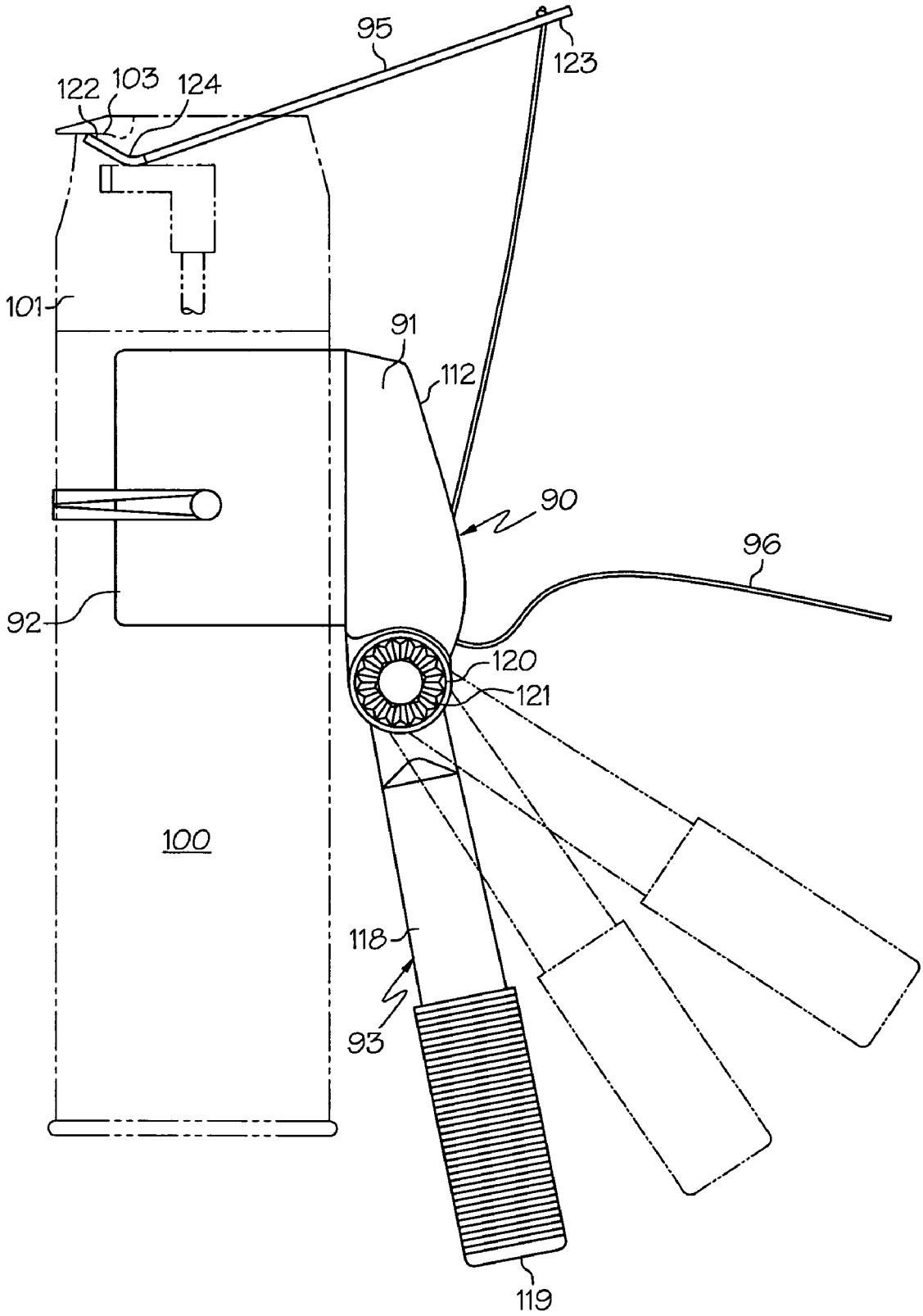
FIG. 7 is a side elevation view of still another article of the invention and further showing an angle adjustability feature.
Figure 8:
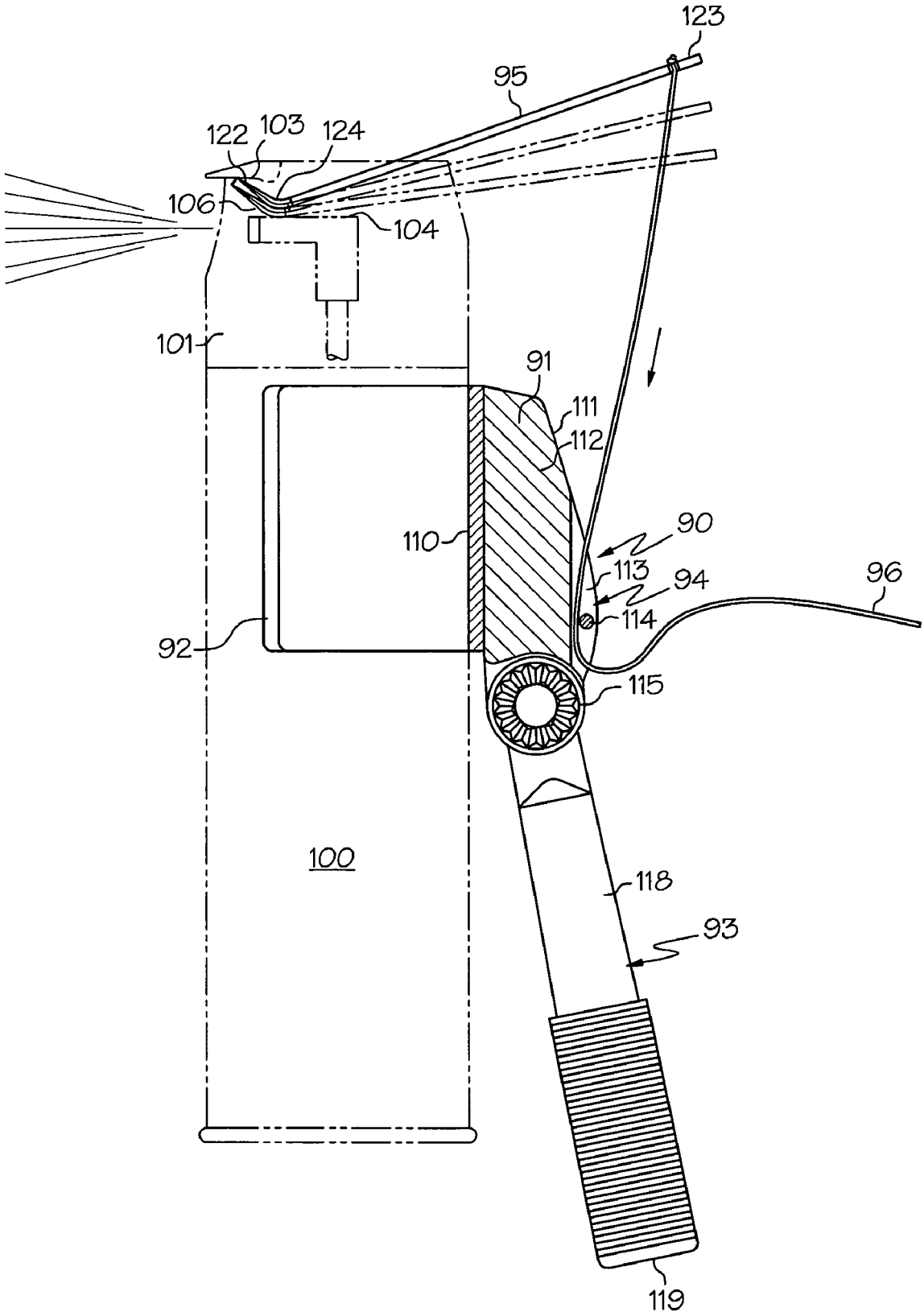
FIG. 8 is a side elevation view in section of the article of FIG. 7.
Figure 9:
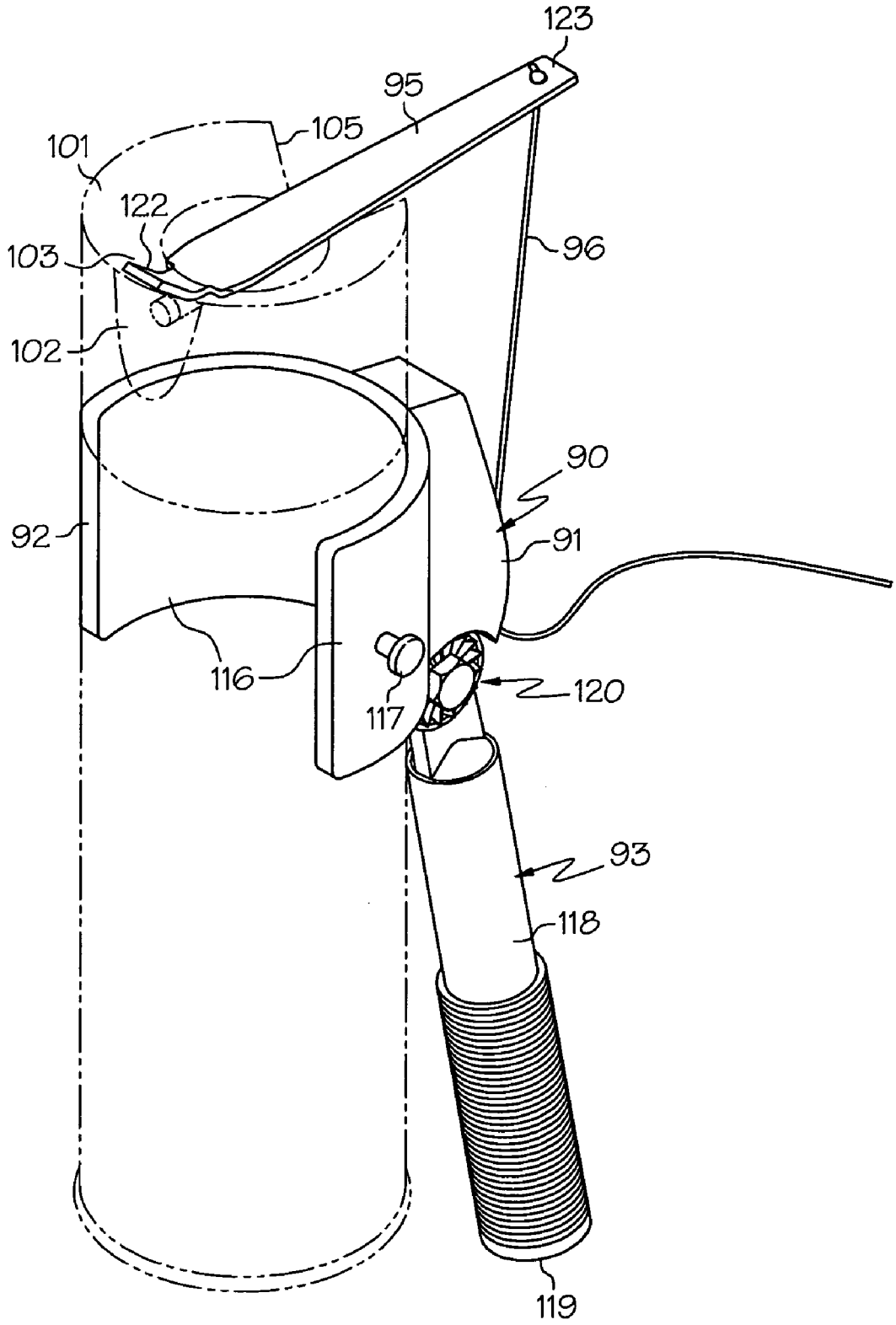
FIG. 9 is a perspective view of the article of FIG. 7.

FIGS. 7-9 illustrate another embodiment of the invention which is similar in function and purpose. The article 90 has a main body 91, a clip 92, a pole adaptor 93, a cord guide 94, a spray lever 95 and a cord 96. It is particularly useful with an aerosol spray container configured with a shielded push button valve actuator. As best seen in FIGS. 7 and 9, the aerosol spray container 100 has a rotatable head 101 with a side opening 102 to accommodate spray emitting from the spray nozzle. A bridge 103 extends over the side opening 102. A top recessed finger rest 104 extends through a side wall opening 105. The opening 105 is for accommodating vertical movement of the spray lever 95 and is opposed the side opening 102. The top surface of the push button valve actuator is substantially even within the finger rest. An open space 106 is created by the valve actuator and the bridge 103 of the rotating head. In this embodiment of the invention, the open space 106 is used to receive a first end of the spray lever 95. In effect, the spray lever pivots about the point at which its end contacts the bridge 103.

The main body 91 of the article 90 has a front wall 110, preferably curved, to receive the aerosol spray container, an opposed back wall 111 and a downwardly extending support bracket 112. A narrow groove 113 extends vertically through the back wall with a guide pin 114 extending horizontally through it. Together they create the cord guide 94. The support bracket 112 has a first serrated fastener component 115 similar in construction to that found on the support bracket of the article 10 previously described.

A resilient plastic is used in making the clip 62. It has two curved arms 116. The arms 116 are wider than the corresponding clip arms of the article 10 since they provides the primary hold-power. An elastic band positioned on the knobs 117 at the ends of the arms greatly enhances the clip's hold-power.

The pole adaptor 93 is identical to that described with reference to FIGS. 1-4. It comprises the elongated body 118, a lower pole-receiving terminus 119 and an attachment means 120. The attachment means comprises a second serrated fastener component 121 to mechanically mate with the first serrated fastener component 113 found on the main body's support bracket 112.

The spray lever 95 is operably associated with the main body 91 through its proper placement in the aerosol spray container and its attachment to the cord 96. The spray lever 95 is an elongated narrow flat body. It has a first end 122 bent upwardly from the narrow flat body, a second end 123 with the cord attached and a mid-section actuator 124 located at the bend where the first end begins.

In operation, an aerosol spray container is positioned between the arms of the article's clip. The spray lever 95 is then slipped into place. Next, the user estimates the proper angle of the aerosol spray container to the pole to most effectively spray the desired object with a full force stream or spray from the container's spray nozzle. The pole adaptor's attachment means to the main body of the article is loosened and the pole adaptor rotated to achieve the proper angle. The attachment means is tightened. Now, with the extension pole on the pole adaptor, the aerosol spray container is moved into close proximity to the object to be sprayed. When sufficiently close, the user pulls on the cord and maintains the tension until adequate spraying has occurred. As should be apparent, the article of the invention accomplishes its objective in all regards. It also should be understood that the aerosol spray container is readily removed from the article and either stored or used in a conventional fashion.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

We claim:

1. An article for holding an aerosol spray container containing an active ingredient under pressure and equipped with a push button valve activator spray nozzle which upon exertion of a downward force initiated from a remote locale by a user releases the active ingredient in a fixed direction stream or spray pattern onto an object, said article comprising:

(a) a main body having a front wall for receiving a cylindrical-shaped aerosol spray container, an opposed back wall, and a support bracket;

(b) a clip extending forwardly from the front wall of the main body, said clip having two resilient arms for receiving the aerosol spray container and holding it firmly to the main body;

(c) a pole adaptor rotatably attached to the support bracket of the main body, said pole adaptor having a receptacle for receiving a terminus of an extension pole and further having an adjustable attachment means for mounting the pole adaptor to the support bracket of the main body at a desired angle dependent on the position of the object to be sprayed relative to the user;

(d) a cord guide positioned on the back wall of the main body;

(e) a spray lever having an elongated body with a first end, a second end and a mid-section actuator, said spray lever operably associated with the main body for exerting at least three pounds force by the mid-section actuator onto the push button valve activator of the aerosol spray container for each pound force exerted on the spray lever's second end to release the active ingredient from the aerosol spray container; and (f) a cord having a distal end and a proximal free end with the distal end secured to the second end of the spray lever for downwardly moving the spray lever from a rest position to a actuator force-imparting position and the proximal free end for grasping by a user of the article and further wherein the cord passes over the cord guide so that a portion of the cord leading to the proximal free end generally follows the pole from the cord guide to the user;

whereby the main body of the article is pre-adjusted by the user to an angle best suited for spraying the desired object with a direct full force spray of the active ingredient when the proximal free end of the cord is manually pulled by the user from the remote locale to cause the mid-section actuator of the spray lever to contact the push button valve activator of the aerosol spray container with sufficient force to release the active ingredient.

2. The article of claim 1 wherein the mid-section actuator is positioned on the elongated body of the spray lever so that for each pound of force exerted on the second end of the spray lever by the cord at least about four pounds of force are exerted by the mid-section actuator onto the push button valve activator of the aerosol spray container.

3. The article of claim 2 wherein the opposed back wall of the main body has a narrow groove extending vertically to a mid-section thereof to create an open space therebetween and further having a guide pin extending horizontally through the groove to form the cord guide.

4. The article of claim 2 wherein the back wall of the main body has a V-shaped member extending horizontally across the main body to form the cord guide which centers the cord as it passes thereover.

5. The article of claim 2 wherein the first end of the spray lever is pivotally attached to the main body.

6. The article of claim 5 wherein the main body has two arms horizontally extending therefrom and parallel to one another with a space therebetween for accommodating the spray lever and further wherein the spray lever is pivotally attached at terminuses of the arms to move within said space.

7. The article of claim 6 wherein the mid-section actuator of the spray lever is a leg extending downwardly from the elongated body at an about right angle.

8. The article of claim 7 wherein the leg of the spray lever has a pad profile at a terminus which comprises a generally flat portion and an upwardly sloped portion for accommodating aerosol spray containers of different lengths.

9. The article of claim 2 wherein the elongated body of the spray lever is bent upwardly near the first end to form the mid-section actuator and further wherein the cord is secured to the spray lever at the second end thereof.

10. An article for holding an aerosol spray container containing an active ingredient under pressure and equipped with a push button valve activator spray nozzle which upon exertion of a downward force initiated from a remote locale by a user releases the active ingredient in a fixed direction stream or spray pattern onto an object, said article comprising:

(a) a main body having a front wall for receiving a cylindrical-shaped aerosol spray container, an opposed back wall, a downwardly extending support bracket, and horizontally extending arms;

(b) a clip extending forwardly from the front wall, said clip having two resilient arms for receiving the aerosol spray container and holding it firmly to the main body;

(c) a pole adaptor rotatably attached to the support bracket of the main body, said pole adaptor having a receptacle for receiving a terminus of an extension pole and further having an adjustable attachment means for mounting the pole adaptor to the bracket of the main body at a desired angle dependent on the position of the object to be sprayed relative to the user;

(d) a cord guide positioned on the back wall of the main body;

(e) a spray lever having an elongated body with a first end, a second end and a mid-section actuator, said spray lever pivotally attached to the horizontally extending arms of the main body for exerting a downward force by the mid-section actuator onto the push button valve activator of at least about three pound force for each pound of force exerted on the second end for releasing the active ingredient from the aerosol spray container; and (f) a cord having a distal end and a proximal free end with the distal end of the cord secured to the second end of the spray lever for downwardly moving the spray lever from a rest position to a force-imparting position and the proximal free end of the cord for grasping by a user of the article and further wherein the cord passes over the cord guide so that a portion of the cord leading to the proximal free end generally follows the pole from the cord guide to the user;

whereby the main body of the article is pre-adjusted by the user to an angle best suited for spraying the desired object with a direct full force spray of the active ingredient when the proximal free end of the cord is manually pulled by the user from the remote locale to cause the mid-section actuator of the spray lever to contact the push button valve activator of the aerosol spray container with sufficient force to release the active ingredient.

11. The article of claim 10 wherein the mid-section actuator is positioned on the elongated body of the spray lever so that for each pound of force exerted on the second end of the spray lever by the cord at least four pounds of force are exerted by the mid-section actuator of the spray lever onto the push button valve activator of the aerosol spray container.

12. The article of claim 11 wherein the opposed back wall of the main body has a narrow groove extending vertically to a mid-section thereof to create an open space therebetween and further having a guide pin extending horizontally through the groove to form the cord guide.

13. The article of claim 11 wherein the opposed back wall of the main body has a V-shaped member extending horizontally across the main body to form the cord guide which centers the cord as it passes thereover.

14. The article of claim 11 wherein the mid-section actuator of the spray lever is a leg extending downwardly from the elongated body at an about right angle.

15. The article of claim 14 wherein the leg of the spray lever has a pad profile at its terminus comprising a generally flat portion and an upwardly sloped portion.

16. An article for holding an aerosol spray container containing an active ingredient under pressure and equipped with a push button valve activator spray nozzle which upon exertion of a downward and forward force initiated from a remote locale by a user releases the active ingredient in a fixed direction stream or spray pattern onto an object, said article comprising:

(a) a main body having a front wall for receiving a cylindrical-shaped aerosol spray container, an opposed back wall, a downwardly extending support bracket, and two horizontally extending arms parallel to one another to create a space therebetween;

(b) a clip extending forwardly from the front wall, said clip having two resilient arms for receiving the aerosol spray container and holding it firmly to the main body;

(c) a pole adaptor rotatably attached to the support bracket of the main body, said pole adaptor having a receptacle for receiving a terminus of an extension pole and further having an adjustable attachment means for mounting the pole adaptor to the bracket of the main body at a desired angle dependent on the position of the object to be sprayed relative to the user;

(d) a V-shaped member positioned on the back wall of the main body and extending horizontally thereacross for serving as a cord guide;

(e) a spray lever having an elongated body with a first end, a second end and a mid-section actuator wherein said mid-section actuator is a leg extending downwardly from the elongated body at an about right angle, said spray lever pivotally attached at its first end to the horizontally extending arms of the main body to move therebetween for exerting a downward force by the mid-section actuator onto the push button valve activator of at least about four pounds force for each pound of force exerted on the second end; and (f) a cord having a distal end and a proximal free end with the distal end of the cord secured to the second end of the spray lever for moving downwardly the spray lever from a rest position to a force-imparting position and the proximal free end of the cord for grasping by a user of the article and further wherein the cord passes over the cord guide so that a portion of the cord leading to the proximal free end generally follows the pole from the V-shaped member on the back wall of the main body to the user;

whereby the main body of the article is pre-adjusted by the user to an angle best suited for spraying the desired object with a direct full force spray of the active ingredient when the proximal free end of the cord is manually pulled by the user from the remote locale to cause the mid-section actuator of the spray lever to contact the push button valve activator of the aerosol spray container with sufficient force to release the active ingredient.

17. The article of claim 16 wherein the leg of the spray lever has a pad profile at its terminus comprising a generally flat portion and an upwardly sloped portion for accommodating different length aerosol spray containers held by the article.

18. The article of claim 17 wherein the spray lever has two finger members extending horizontally from the elongated body at the first end and further wherein each of the two horizontally extending arms of the main body have a notch at a terminus to pivotally receive one of the finger members.

* * * * *